US006482051B1

(12) United States Patent
Ide et al.

(10) Patent No.: US 6,482,051 B1
(45) **Date of Patent: *Nov. 19, 2002**

(54) CONNECTION STRUCTURE FOR CLAD ELECTRIC WIRE

(75) Inventors: Tetsuro Ide, Shizuoka-ken (JP); Tadahisa Sakaguchi, Shizuoka-ken (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/349,934

(22) Filed: Jul. 8, 1999

(30) Foreign Application Priority Data

Jul. 9, 1998 (JP) ..... 10-194722

(51) Int. Cl.[7] ..... H01R 4/02

(52) U.S. Cl. ..... 439/874; 156/73.1; 439/604; 439/466

(58) Field of Search ..... 439/656, 606, 439/874, 604, 466, 467; 156/563, 580.1, 580.2, 583.1, 73.1, 73.2, 293; 264/272.11, 272.14, 279.1, 442, 443, 254

(56) References Cited

U.S. PATENT DOCUMENTS 787,400 A * 4/1905 Roos ..... 264/159
5,419,864 A * 5/1995 Sheer et al. ..... 264/254
6,027,589 A * 2/2000 Kato et al. ..... 156/73.2
6,036,908 A * 3/2000 Nishida et al. ..... 264/254
6,059,617 A * 5/2000 Shinchi ..... 439/874

FOREIGN PATENT DOCUMENTS

JP 7-70345 7/1995
JP 9-293577 11/1997

* cited by examiner

*Primary Examiner*—Tho D. Ta
*Assistant Examiner*—James R. Harvey
(74) *Attorney, Agent, or Firm*—Finnegan, Henderson, Farabow, Garrett & Dunner, L.L.P.

(57) ABSTRACT

A connection structure for a conductive connection between a clad electric wire and a member according to the present invention comprises a member having a conductivity, a clad electric wire superposed on the member, a resinous layer disposed between the member and the clad electric wire, and a pair of resinous parts clamping the clad electric wire and the member at their superposed portion. The clad electric wire has a conductor portion and a resin-made clothing portion clothing an outer periphery of the conductor portion. The superposed portion is pressurized and ultrasonically excited through the resinous parts, with the result that the clothing portion is scattered and melted; the resin portion is melted; the conductor portion is conductively connected to the member; and the resinous parts are fused together in a state of their clothing the superposed portion. Accordingly, the resin-made clothing portion of the clad electric wire is ultrasonically excited in a state where the clothing portion is not directly contacted with the member but contacted with the resinous layer.

4 Claims, 6 Drawing Sheets

CONNECTION STRUCTURE FOR CLAD ELECTRIC WIRE

BACKGROUND OF THE INVENTION

The present invention relates to a connection method and connection structure for making a connection of a clad electric wire with a contactor, terminal, or other electric wires.

As related connection methods, there are a first related technique described in Japanese Patent Application Publication No. H7-70345 and a second related technique described in Japanese Patent Application Laid-Open Publication No. H9-293577.

SUMMARY OF THE INVENTION

In the above-described first related technique, a clad electric wire is clamped between a contact member consisting of a metal plate and resin parts and the resulting clamping is caused to undergo ultrasonic excitation. Ultrasonic excitation is performed of the metal and resin whose heat conductivities are different from each other. For this reason, a difference occurs between the two in terms of the heat generated therefrom, with the result that the elimination effect of eliminating a clothing portion of the clad electric wire by ultrasonic excitation is decreased and so it is impossible to smoothly eliminate the clothing portion. As a result of this, the clothing portion of the clad electric wire remains to exist at a portion of connection of the clad electric wire with the contact member, or gases generate from the clothing portion that remains to exist. Whereby, there is the possibility that the contact resistance will increase. Also, there is the possibility that a conductor portion of the clad electric wire and the contact member will deteriorate due to the gases generated.

On the other hand, in the second related technique, it is necessary to perform the operation of twisting a plurality of clad electric wires. Therefore, the operating efficiency is bad. Also, since the clad electric wires are brought into a state of their being twisted together, it is difficult, at the time of ultrasonic excitation, to reliably eliminate the clothing portion of the clad electric wire and so the clothing portion remains to exist at the portion of connection. As a result of this, there is the possibility that the contact resistance will increase and gases will generate to cause deterioration of the conductor portion of the clad electric wire.

In view of the above, an object of the present invention is to provide a connection method and connection structure for a clad electric wire that enables the reliable elimination of the clothing portion of the clad electric wire by ultrasonic excitation to thereby decrease the contact resistance and that enables the prevention from deterioration of the conductively connected portion, conductor portion, etc.

To attain the above object, the present invention provides a connection structure for making a conductive connection between a clad electric wire and a member, which is comprised of a member having a conductivity, a clad electric wire to be superposed on the member, a resinous layer disposed between the member and the clad electric wire, and a pair of resin parts clamping the superposed portions between the clad electric wires and the member. The clad electric wire has a conductor portion and a resin-made clothing portion covering the outer periphery of the conductor portion. The superposed portions have a pressure applied thereto via the resinous parts and ultrasonic excitation is performed with respect thereto. As a result of this, the clothing portion is scattered and fused and as a result the resinous portion is fused. As a result, the conductor portion and the member are conductively connected and the mated resinous parts are fused together in the state of their clothing the superposed portions.

The above-described connection structure is provided through the following method. First, the clad electric wire and the member are superposed one upon the other. Then, the superposed portions between the clad electric wires and the member are clamped by the pair of resinous parts. At this time, the resinous layer is disposed between the clad electric wire and the member. Next, the superposed portions have a pressure applied thereto via the resinous parts and are ultrasonically excited.

In the above-described structure and method, in a state where the resinous layers are disposed between the clad electric wires and the member, ultrasonic excitation and pressure application are performed with respect to the resulting assembly. Accordingly, the resinous clothing portion of the clad electric wire is ultrasonically excited in direct contact with the resinous layer without directly contacting with the member.

The difference in heat conductivity between resins is very small compared to the difference in heat conductivity between resin and metal. Therefore, when ultrasonically excited, the clothing portion and the resinous portion equally generate heat. For this reason, the clothing portion is excellently fused and scattered and so it is very unlikely that the clothing portion will remain to exist between the conductor portion and the member. Accordingly, the increase in contact resistance due to the residual existence of the clothing portion and the deterioration of the conductor portion and the member due to the generation of gases are prevented.

The resinous layer may be formed integrally with one of the resinous parts and the member may be held between the one of the resinous parts and the resinous layer.

In the above-described construction, by superposing the clad electric wire on the resinous layer, the resinous layer is disposed necessarily between the clad electric wire and the member. Therefore, the operation efficiency of conductive connection is enhanced.

The member may be constructed of a terminal metal fitting equipped with a connection piece portion. This connection piece portion is embedded into one of the resinous parts.

In the above-described construction, in a state where the increase in contact resistance and the deterioration in the terminal metal fitting have been prevented, the clad electric wire and the terminal metal fitting are connected.

DESCRIPTION OF THE PREFERRED EMBODIMENTS

First Embodiment

A first embodiment of the present invention will now be explained with reference to the drawings. It is to be noted that in the following explanation the wording "vertical direction" represents the vertical direction in the figures.

Figure 1:
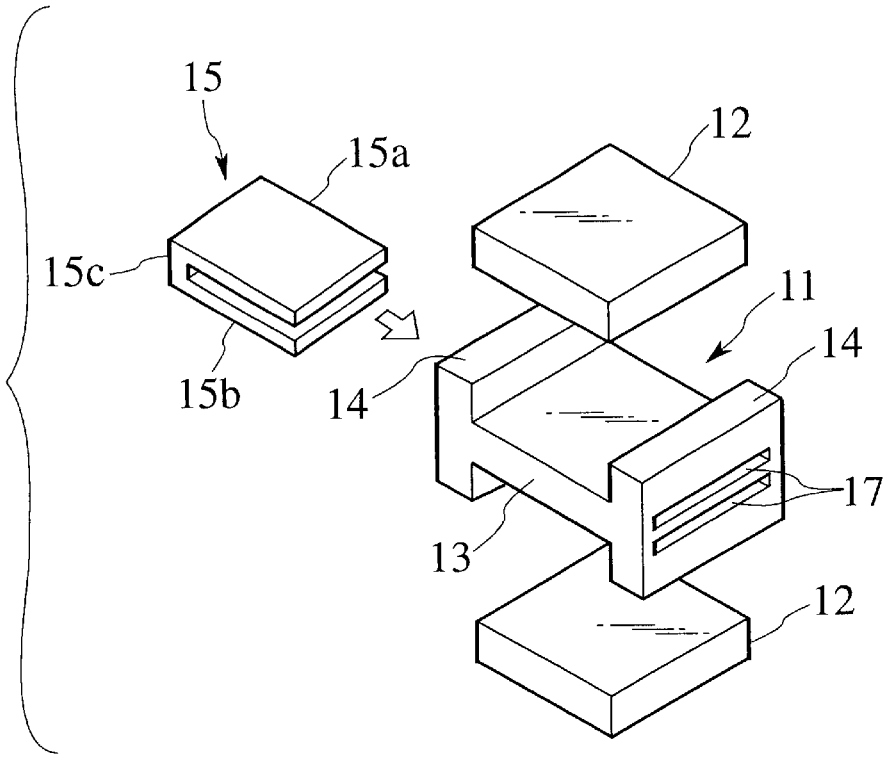
FIG. 1 is an exploded perspective view illustrating a first embodiment of the present invention.

As illustrated in FIG. 1, a connection structure of this embodiment is constructed of a clad electric wire 21, a first resinous parts 11, second paired resinous parts 12, a resin portion 16 serving as a resinous layer, and a contactor 15.

The first resinous parts 11 have an H-shaped configuration and is composed of two vertical plate portions 14 and a horizontal plate portion 13 connecting the vertical plate portions 14 to each other.

Figure 4A:
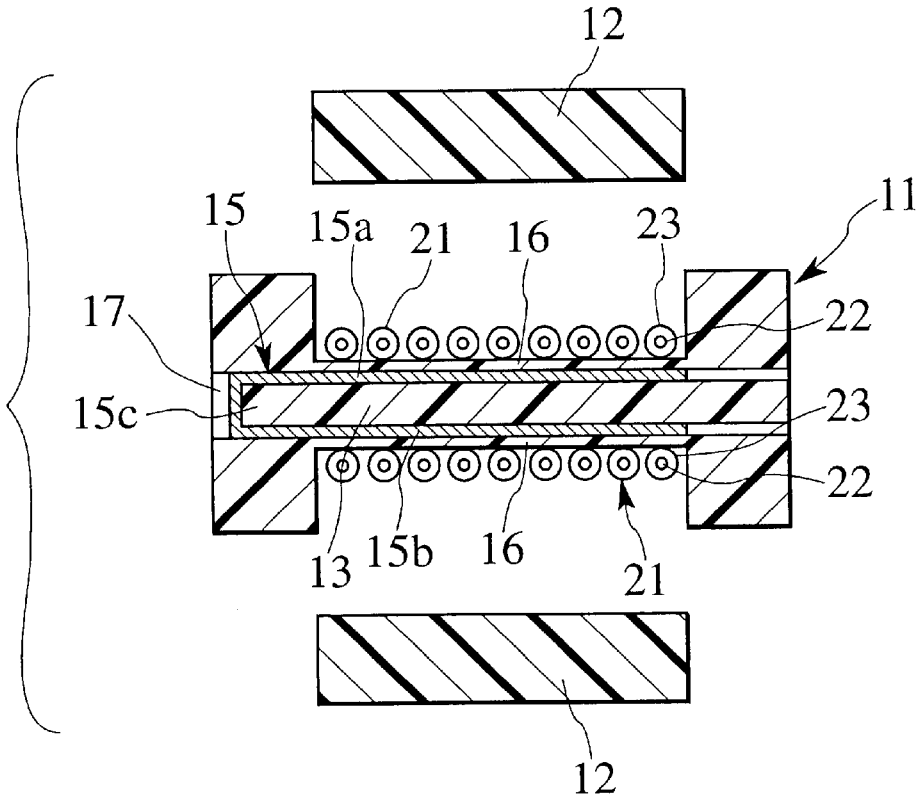
FIG. 4A is a sectional view illustrating a state prior to the pressure application and ultrasonic excitation of FIG. 1.

The contactor 15 has a horizontally thrown U shaped configuration which is composed of a pair of horizontal connection piece portions 15*a*, 15*b*, and a coupling piece portion 15*c* coupling between the ends on one side of the connection piece portions 15*a*, 15*b*. As illustrated in FIG. 4A, the resin portion 16 constitutes upper and lower surfaces of the horizontal plate portion 13 of the first resinous parts 11. In a state where the contactor 15 has been embedded in the horizontal plate portion 13, the connection piece portions 15*a*, 15*b* are disposed along the resin portion 16.

As illustrated in FIG. 1, the embedding of the contactor 15 can be readily done by forming the first resinous parts 11 having an embedding hole 17 opened at side surface portions thereof and then inserting the contactor 15 into the embedding hole 17. Also, the embedding of the contactor 15 may be done by insert molding which is performed by inserting the contactor 15 into the cavity of a mold for forming the first resinous parts 11 and thereafter performing injection molding.

Each of the second paired resinous parts 12 is formed into a flat plate-like configuration. The second paired resinous parts 12 are fitted to the first resinous parts 11 from above and from below and are thereby superposed on the upper and lower surfaces of the horizontal plate portion 13, respectively.

Figure 3:
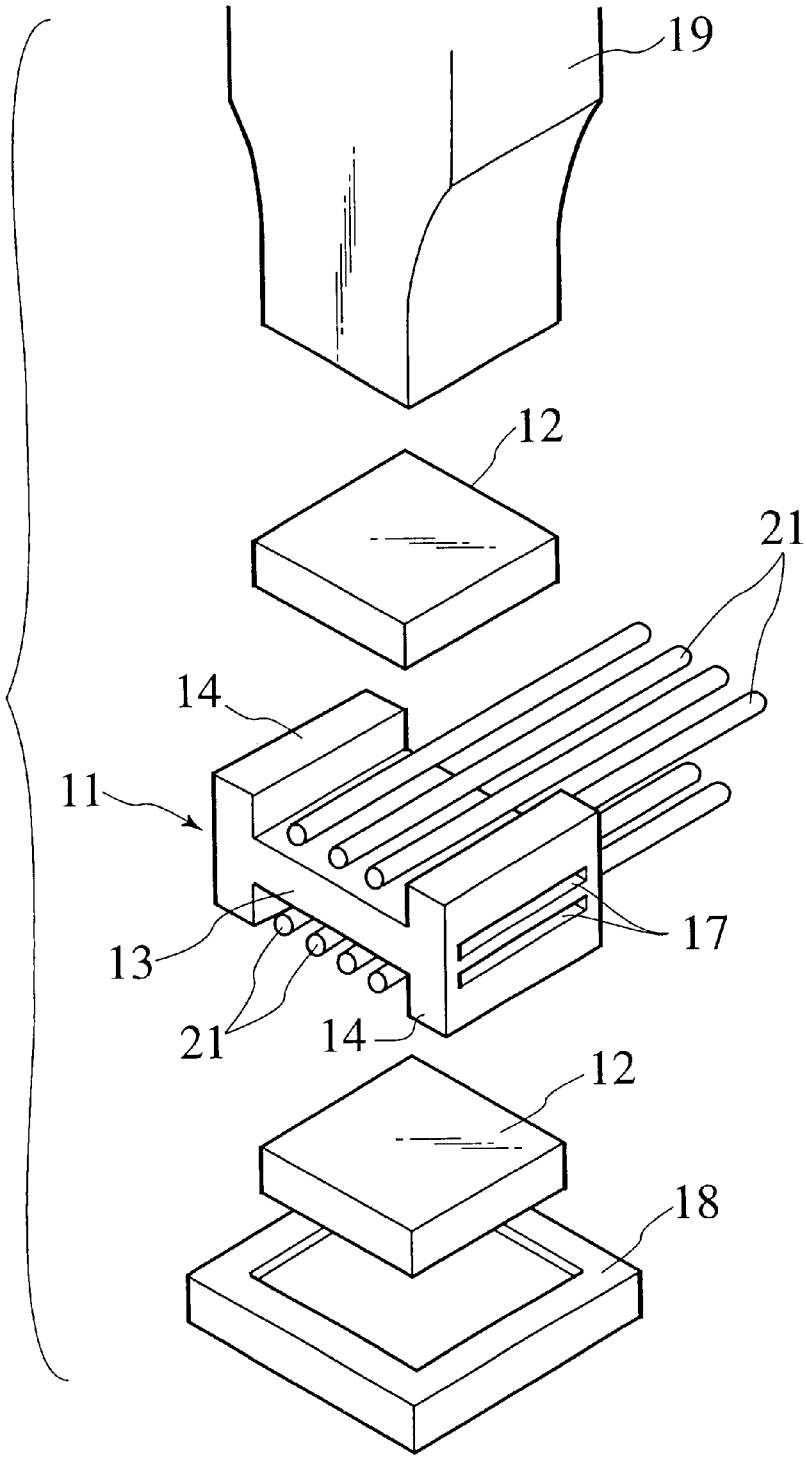
FIG. 3 is an exploded perspective view illustrating a state prior to the pressure application and ultrasonic excitation of FIG. 1.

As illustrated in FIGS. 3 and 4, a clad electric wire 21 is formed of a conductor portion 22 which is an aggregation of core wires, and a resin-made clothing portion 23 clothing the conductor portion 22 at around the same. The conductor portion 22 is conductively connected to the contactor 15.

As the resin constituting the clothing portion 23 of the clad electric wire 21, a vinyl chloride resin is used. On the other hand, as the resin constituting each of the first and second resinous parts 11, 12, acrylic based resin, ABS (acrylbutadiene-styrene copolymer) based resin, PC (polycarbonate) based resin, polyolefine based resin such as polyethylene, PEI (polyether imide) based resin, PBT (polybutylene terephthalate) based resin or the like is used. These resins each have the quality of being hard compared to the resin constituting the clothing portion 23 of the clad electric wire 21.

Next, a connection method for a connection between the clad electric wire 21 and the contactor 15 will be explained.

First, as illustrated in FIG. 3, a plurality of the clad electric wires 21 are contacted at the terminal ends with the first resinous parts 11 having the contactor 15 embedded therein. Specifically, the terminal end portions of the clad electric wires 21 are contacted with the upper and lower surfaces of the horizontal plate portion 13 of the first resinous parts 11.

Figure 2:
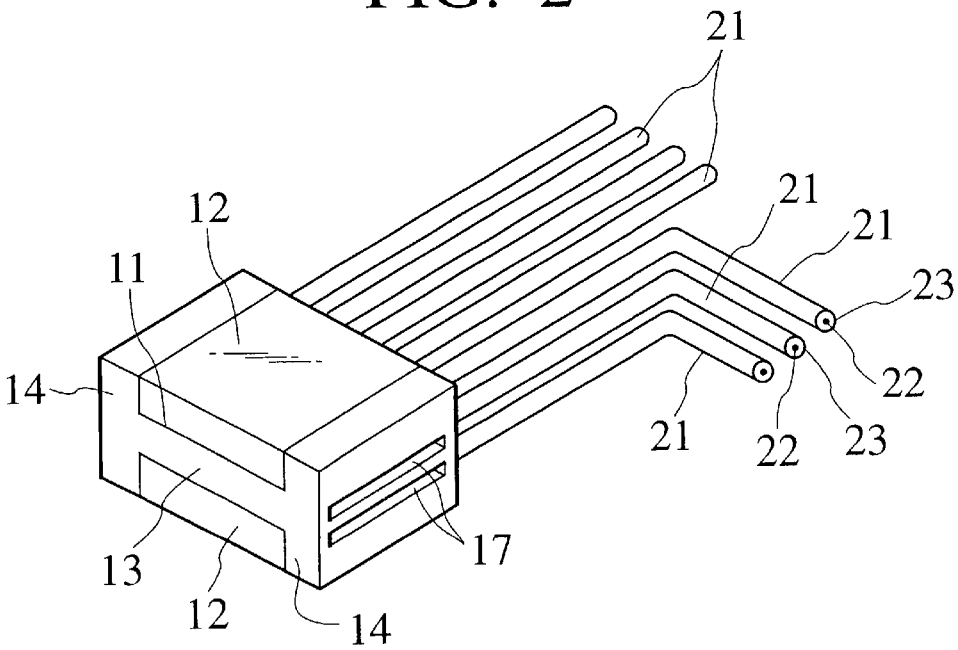
FIG. 2 is a perspective view illustrating clad electric wires clamped by resinous parts.

Next, as illustrated in FIG. 2, the second resinous parts 12 are fitted to the first resinous parts 11 and the first and second resinous parts 11 and 12 are caused to clamp the terminal end, portions of the clad electric wires 21. In this state, as illustrated in FIG. 4A, the clothing portion 23 contacts with the horizontal plate portion 13 and the resin portion 16 intervenes between the clothing portion 23 and the connection piece portions 15*a*, 15*b* of the contactor 15.

Next, as illustrated in FIG. 3, an anvil 18 and a horn 19 are abutted onto the upper and lower second resinous parts 12, respectively, and, while applying a pressure onto the resulting assembly, the horn 19 is ultrasonically excited.

During the ultrasonic excitation, the resin-made clothing portion 23 contacts with the resin portion 16 without direct contact between the clad electric wire 21 and the contactor 15. Since the difference in heat conductivity between resins is very small compared to the difference in heat conductivity between resin and metal, the clothing portion 23 and the resin portion 16 equally generate heat due to the ultrasonic excitation. In addition, because the resinous parts 11, 12 are harder than the clothing portion 23, the clothing portion 23 is melted and scattered before the resinous parts 11, 12 are melted due to the ultrasonic excitation. For this reason, the conductor portion 22 of the clad electric wire 21 is exposed.

Figure 4B:
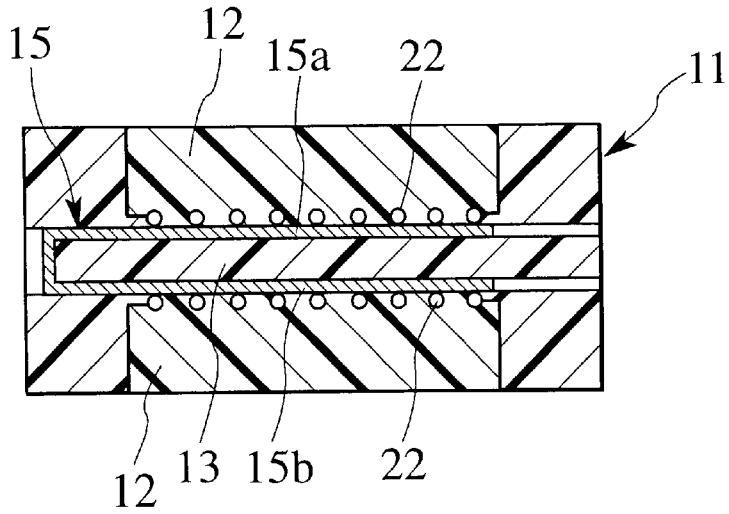
FIG. 4B is a sectional view illustrating a state after the pressure application and ultrasonic excitation of FIG. 1.

By further continuously performing the pressure application and ultrasonic excitation, the resinous parts 11, 12 are melted at the interface portion including the resin portion 16. As a result of this, as illustrated in FIG. 4B, the conductor portion 22 and the connection piece portions 15*a*, 15*b* are contacted with and conducted to each other, whereby a plurality of the clad electric wires 21 are connected to each other through the contactor 15. Also, simultaneously, the resinous parts 11 and 12 are simultaneously melted at the interface portion, whereby the conductively connected portion between the conductor portion 22 and the contactor 15 are fixed by the resinous parts 11 and 12.

In this conductive connection, since the resin portion 16 intervenes between the clothing portion 23 of the clad electric wire 21 and the contactor 15, generation of heat equally occurs from the clothing portion 23 and the resin portion 16. For this reason, the clothing portion 23 is excellently scattered and therefore it is unlikely that the clothing portion 23 remains to exist between the conductor portion 22 and the contactor 15. This prevents the increase in contact resistance resulting from the residual existence of the clothing portion 23. Also, no gases generates from the clothing portion 23 which has remained to exist and this prevents the deterioration of the conductor portion 22 and the contactor 15.

Further, since a plurality of clad electric wires 21 can be connected to each other through the contactor without being twisted together, the operating efficiency is enhanced.

In addition, in this embodiment, since the contactor 15 is embedded in the first resinous parts 11, the resin portion 16 is necessarily disposed between the clad electric wire 21 and the contactor 15 by superposing the clad electric wire 21 on the resin portion 16. Therefore, the time and labor for disposing the resin portion 16 can be omitted and so the operation efficiency of the conductive connection is enhanced.

Second Embodiment

Figure 5:
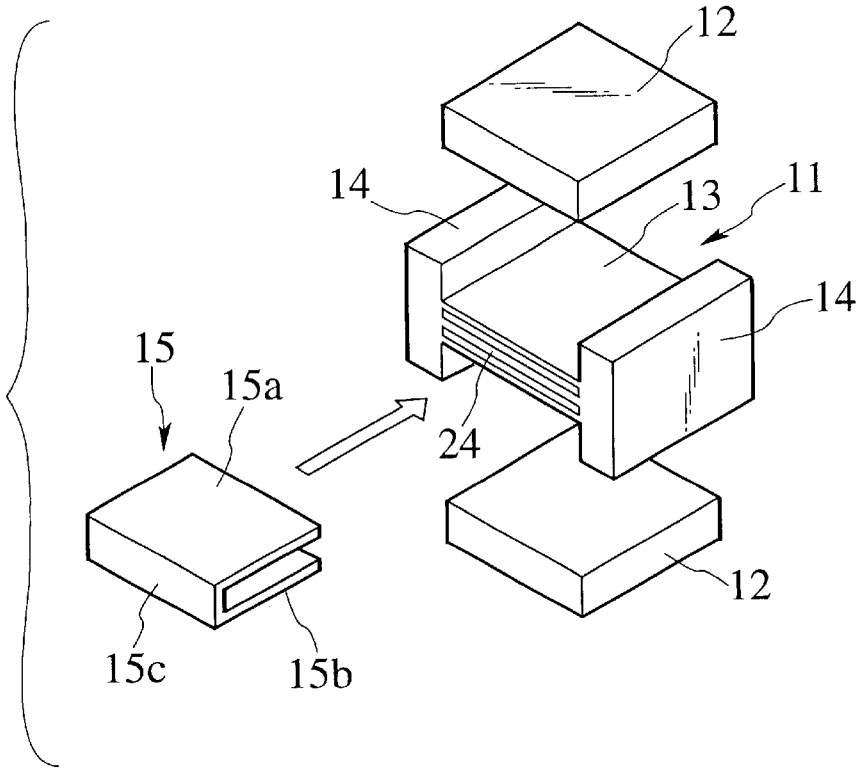
FIG. 5 is an exploded perspective view illustrating a second embodiment of the present invention.

Next, a second embodiment of the present invention will be explained with reference to FIGS. 5 to 7. This embodiment is a modification wherein the direction of embedding the contactor 15 according to the first embodiment is altered, and the same portions or components as those in the first embodiment are denoted by like reference symbols and an explanation thereof is omitted.

In this embodiment, the contactor 15 is inserted directly into the horizontal plate portion 13 of the first resinous parts 11. Therefore, at the front portion of the horizontal plate portion 13 there is formed an embedding hole 24 into which the contactor 15 is inserted.

Figure 6:
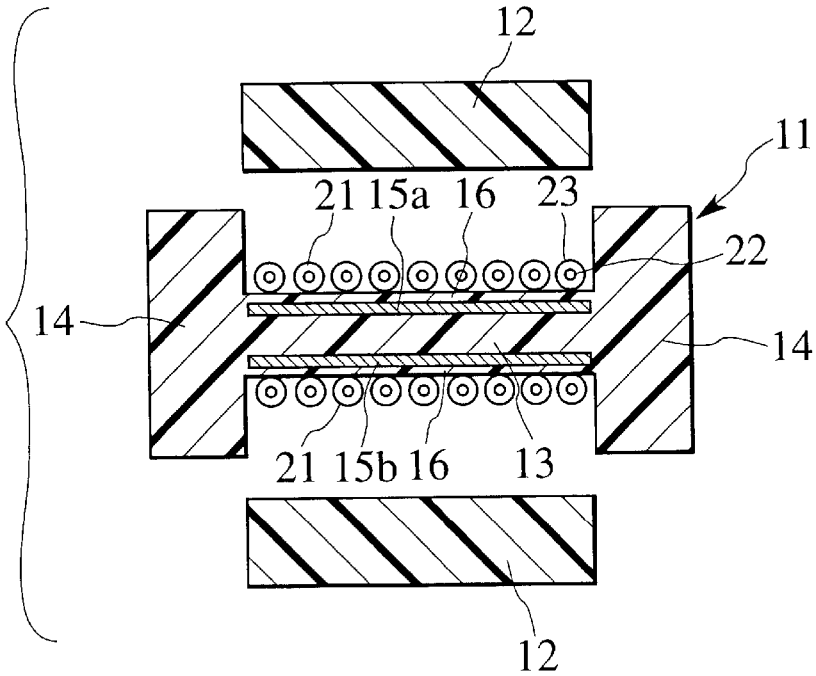
FIG. 6 is a sectional view illustrating a state prior to the pressure application and ultrasonic excitation of FIG. 5.
Figure 7:
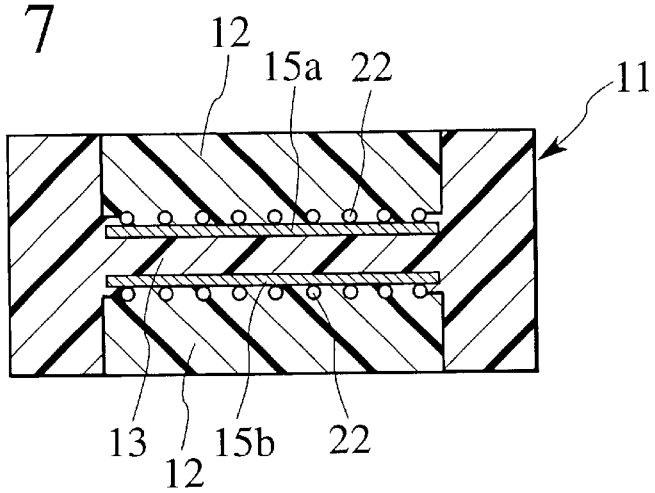
FIG. 7 is a sectional view illustrating a state after the pressure application and ultrasonic excitation of FIG. 5.

As illustrated in FIG. 6, in this embodiment as well, the resin portion 16 is disposed between the clad electric wire 21 and. the contactor 15, whereby direct contact therebetween is prevented from occurring. Therefore, the clothing portion of the clad electric wire 21 is excellently melted and scattered, whereby the conductor portion 22 and the connection piece portions 15*a*, 15*b* are reliably contacted with each other (as illustrated in FIG. 7). As a result of this, a conductive connection without increase in the contact resistance is provided.

Third Embodiment

Figure 8:
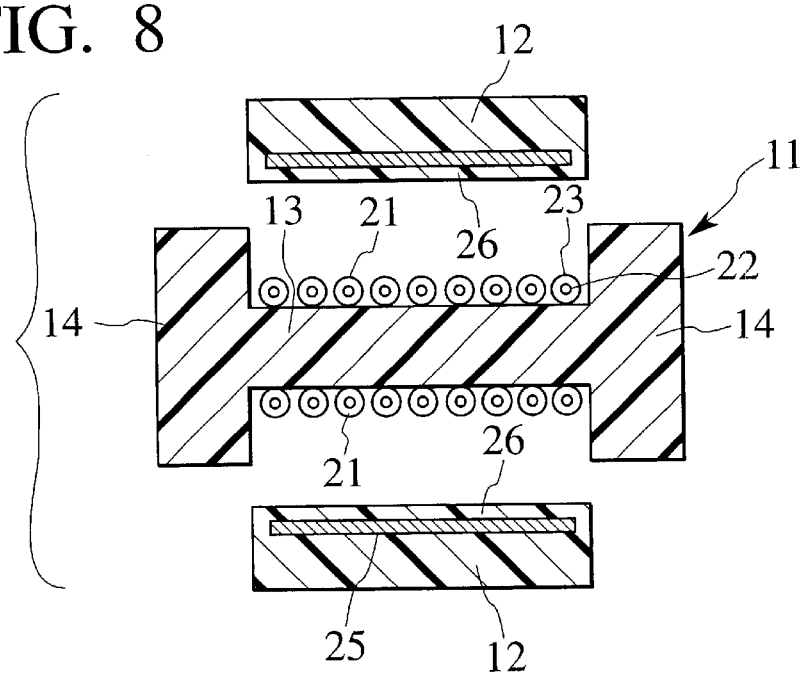
FIG. 8 is a sectional view illustrating a third embodiment of the present invention.
Figure 9:
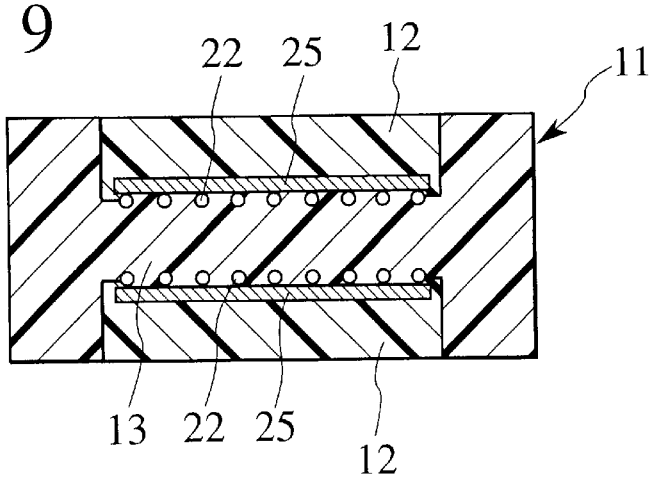
FIG. 9 is a sectional view illustrating a state after the pressure application and ultrasonic excitation of FIG. 8.

Next, a third embodiment of the present invention will be explained with reference to FIGS. 8 and 9. In this embodiment, a plate-like contactor 25 is embedded into each of the pair of second resinous parts 12. The surfaces of the second resinous parts 12 opposing the horizontal plate portion 13 constitute them resin portion 26 serving as the resinous layer.

In this embodiment, by fitting the second resinous parts 12 onto the first resinous parts 11 with the clad electric wires 21 being contacted with the horizontal plate portion 13 of the first resinous parts 11, the resinous parts 11 and 12 are caused to clamp the clad electric wires 21 and in this state pressure application and ultrasonic excitation are made with respect to the resulting clamping. Since the resin portion 26 intervenes between the clad electric wires 21 and the contactor 25, the clothing portion 23 and the resinous parts 11 and 12 similarly generate heat. For this reason, the clothing portions 23 of the clad electric wires 21 are excellently scattered and melted, whereby a conductive connection without increase in contact resistance is provided.

As shown in FIGS. 1, and 4A–9, the horizontal connection piece portions 15*a*, 15*b* and the plate-like contactor 25 are plate-like members.

Fourth Embodiment

Figure 10:
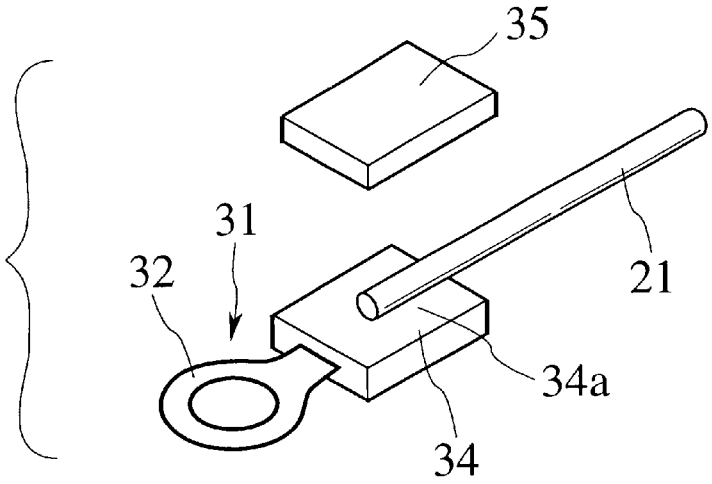
FIG. 10 is an exploded perspective view illustrating a fourth embodiment of the present invention.
Figure 11:
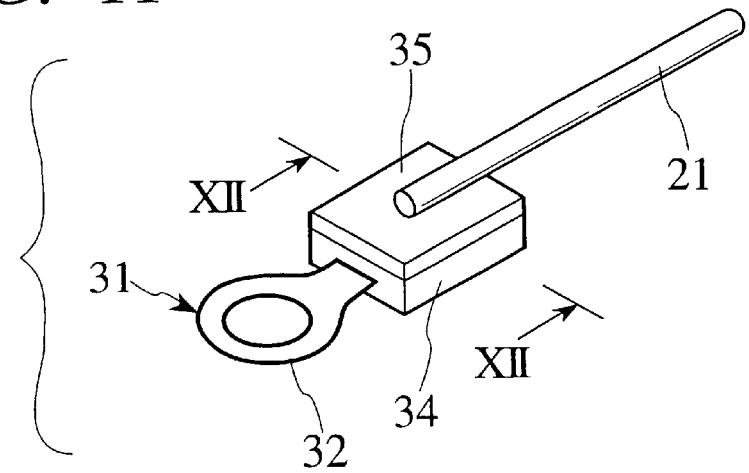
FIG. 11 is a perspective view illustrating a state after a fusion of FIG. 10.
Figure 12:
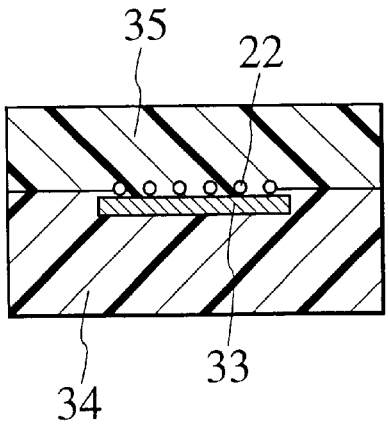
FIG. 12 is a sectional view illustrating a section taken along a line XII—XII of FIG. 11.

FIGS. 10 to 12 illustrate a fourth embodiment wherein the present invention is applied to a terminal metal fitting 31. As illustrated in FIG. 10, the terminal metal fitting 31 has a screw-fastening piece portion 32 at a forward end portion thereof. As illustrated in FIG. 12, at a base end portion of the terminal metal fitting 31, there is provided a connection piece portion 33. The connection piece portion 33 is in the shape of a flat plate and this connection piece portion 33 is embedded into a first resinous parts 34 which is a chip-like flat plate. The surface of the first resinous parts 34 constitutes a resin portion 34a serving as a resinous layer.

The clad electric wires 21 are caused to contact with the surface (the resin portion 34*a*) of the first resinous parts 34 integrally having the terminal metal fitting 31 and are caused to be clamped by means of the second resinous parts 35. In this state, pressure application and ultrasonic excitation are performed with respect to the resulting assembly. As a result of this, as illustrated in FIG. 11, the first and second resinous parts 34, 35 are fused and the clad electric wires 21 are thereby fixed. Also, since the clothing portions 23 of the clad electric wires 21 are excellently scattered and melted by the pressure application and ultrasonic excitation, as illustrated in FIG. 12 the conductor portions 22 and the contact piece portion 33 are reliably contacted and conducted to, each other. As a result, the screw-fastening terminal without increase in contact resistance is provided.

Additionally, if the connection structure and method are ones wherein the clad electric wire 21 and resinous parts are used and the resulting assembly is pressurized and ultrasonically excited, the present invention is not limited to the above-described embodiments and permits various modifications and changes to be made. For instances, the present invention can be applied to a connection structure for a connection between clad electric wires, a connection between a clad electric wire and an ordinary terminal, a connection between a clad electric wire and a connector, and other connection structures.

What is claimed is:

1. A connection structure comprising:

a plate-like member having a conductivity;

a clad electric wire superposed on the plate-like member to form a superposed portion, the clad electric wire having a conductor portion and a resin-made clothing portion clothing an outer periphery of the conductor portion;

a resinous layer disposed between the plate-like member and the clad electric wire; and a pair of resinous parts clamping the clad electric wire and the plate-like member at their superposed portion, the superposed portion being pressurized and ultrasonically excited through the resinous parts, such that the clothing portion is scattered and melted; the resinous layer is melted; the conductor portion is conductively connected to the plate-like member; and the resinous parts are fused together clothing the superposed portion.

2. A connection structure according to claim 1, wherein the resinous layer is formed integrally with one of the resinous parts.

3. A connection structure according to claim 2, wherein the plate-like member is held between one of the resinous parts and the resinous layer.

4. A connection structure comprising:

a member having a conductivity;

a clad electric wire superposed on member to form a superposed portion, the clad electric wire having a conductor portion and a resin-made clothing portion clothing an outer periphery of the conductor portion;

a resinous layer disposed between the member and the clad electric wire; and a pair of resinous parts clamping the clad electric wire and the member at their superposed portion, the superposed portion being pressurized and ultrasonically excited through the resinous parts, such that the clothing portion is scattered and melted; the resinous layer is melted; the conductor portion is conductively connected to the member; and the resinous parts are fused together clothing the superposed portion, wherein the resinous layer is formed integrally with one of the resinous parts, the member is constituted by a terminal metal fitting comprising a connection piece portion, and the connection piece portion is held between one of the resinous parts and the resinous layer.

* * * * *